United States Patent [19]

La Shier

[11] Patent Number: 4,932,873

[45] Date of Patent: Jun. 12, 1990

[54] TERMINATOR ASSEMBLY

[75] Inventor: John L. La Shier, Endicott, N.Y.

[73] Assignee: Amphenol Interconnect Products Corporation, Endicott, N.Y.

[21] Appl. No.: 306,494

[22] Filed: Feb. 6, 1989

[51] Int. Cl.[5] ..... H01R 9/09

[52] U.S. Cl. ..... 439/76; 439/77; 439/404; 439/493; 439/620; 29/842

[58] Field of Search ..... 439/71, 72, 76–78, 439/83, 404, 406, 493, 499, 581, 620, 868, 876, 676; 29/865, 866, 842, 854

[56] References Cited

U.S. PATENT DOCUMENTS

| | | | |
|---|---|---|---|
| 4,268,105 | 5/1981 | Widmayer et al. | 339/147 R |
| 4,493,007 | 1/1985 | Sugitani | 361/307 |
| 4,508,403 | 4/1985 | Weltman et al. | 339/28 |
| 4,538,873 | 9/1985 | Worth | 439/404 |
| 4,588,239 | 5/1986 | Venaleck | 29/842 |
| 4,610,493 | 9/1986 | Masek | 339/14 R |
| 4,639,054 | 1/1987 | Kersbergen | 339/14 R |
| 4,639,063 | 1/1987 | Muller | 439/77 |
| 4,691,977 | 9/1987 | Marzili et al. | 439/404 |
| 4,808,122 | 2/1989 | Tomizu et al. | 439/404 |
| 4,869,685 | 9/1989 | Olsson | 439/404 |

FOREIGN PATENT DOCUMENTS

| | | |
|---|---|---|
| 2543513 | 3/1977 | Fed. Rep. of Germany . |
| WO81/00491 | 2/1981 | PCT Int'l Appl. . |
| 2133227 | 7/1984 | United Kingdom . |

OTHER PUBLICATIONS

*IBM Technical Disclosure Bulletin,* vol. 10, No. 11, Apr. 1968, p. 1657, R. J. Betz, "Combined Memory Core Plane and Circuit Module".

*Primary Examiner*—P. Austin Bradley
*Attorney, Agent, or Firm*—Bacon & Thomas

[57] ABSTRACT

An integral terminator/connector assembly permits a terminator to be connected to a flat cable in a single step after pre-assembly of the terminator to the connector. The terminator is pre-connected to the connector by locating a terminator circuit board on a DIP-type connector substrate between the two rows of pins, and bending the pins over the edge of the terminator board. The connector may include a molded plastic cover to enclose the terminator board.

19 Claims, 3 Drawing Sheets

TERMINATOR ASSEMBLY

BACKGROUND OF THE INVENTION

1. Field of the Invention.

The present invention relates to electrical connectors and, in particular, to an assembly and method for connecting a terminator to a cable.

2. Description of Related Art.

Conventionally, cable termination circuits, including terminators, noise suppression circuits, and peak suppressors, have had to be electrically connected to a cable by first connecting a connector to the cable, and then connecting the circuit to the connector, for example by plugging the connector into outlets provided on the circuit board.

While this method of attaching a cable termination circuit to a cable is not complicated, it has been proposed to make the attachment process even simpler by pre-integrating the connector and the circuit so that a user of the termination circuit can easily connect the circuit board to the cable by simply attaching the connector to the cable, without the need for subsequently adding a circuit board.

An example of a prior art assembly for connecting a circuit to a flat cable, in which the circuit may be pre-connected to the connector, is found in Pat. No. 4,610,493 to Masek. Masek discloses a ribbon cable connector which carries two rows of terminal pins. A transient suppression circuit consisting of resistors is pre-connected to the terminals of the connector. After attaching the connector to the cable, clips and a cover are added for the purpose of holding the assembly together.

While relatively simple, the assembly of Masek is disadvantageous because it requires that each of the circuit elements be soldered directly to the pins of the connector. Furthermore, the cover cannot be provided as an integral part of the assembly, which means that the circuit must lie exposed until after it has been mated with the cable. If the circuit terminator is to be attached to a cable in situ, e.g., by an unskilled personal computer owner, there is a great danger that the circuit will be damaged during connection to cable.

SUMMARY OF THE INVENTION

The invention improves upon the prior art by providing an optimally simple and reliable assembly and a method for attaching a cable termination circuit to a flat cable. Essentially, the assembly includes a substrate provided with rows of pins extending from one side of the substrate and insulation displacement contacts extending from the other side of the substrate, the pins and contacts being electrically connected to each other. The substrate and a base are adapted to sandwich the flat cable, at which time the insulation displacement contacts penetrate the insulation of the cable and connect the pins to the conductors in the cable.

Preattached to the substrate is a printed circuit board which carries the cable termination circuit. The circuit board fits between the rows of pins and the pins are bent over the circuit board to make contact with the printed circuit. The substrate and base may be parts of an off-the-shelf Dual In-Line Package (DIP) connector, providing a very simple, reliable, and inexpensive method of connection to the flat cable.

In a preferred method, the circuit board is pre-connected to the substrate, or to the top half of a DIP connector, by placing it between the rows of pins. The pins are then bent over the circuit board and the ends of the pins are soldered to conductive landings printed onto the circuit board for the purpose of electrically connecting the circuit to the pins. The substrate can then be attached to a cable at any time by simply placing the cable between the substrate and the base, and attaching the base to the substrate.

Also included in the preferred embodiment is a cover which can be placed on the substrate to enclose the circuit board, the cover protecting the circuit both before and after connection to a cable. The substrate, the circuit board, and the cover form an enclosed unit which can be provided to the user separately from the base, the user connecting the base and substrate to the cable of his choice. The entire assembly can be disassembled from the cable and put on a different cable without exposing the circuit.

DESCRIPTION OF THE PREFERRED EMBODIMENT

1. Terminator/Connector Assembly.

Figure 3:
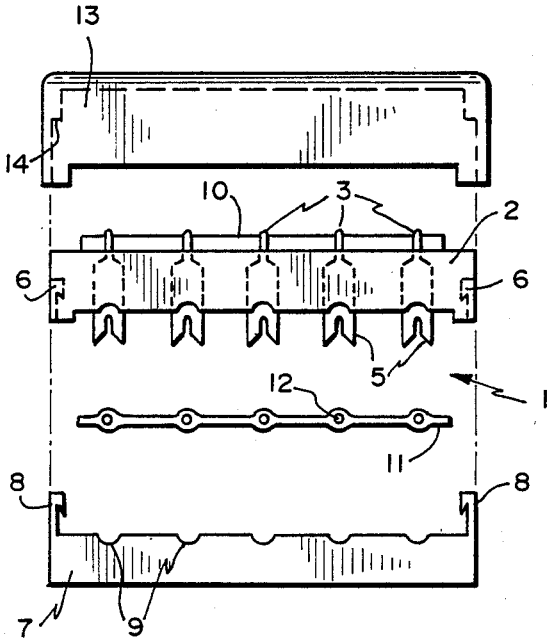
FIG. 3 is a side view showing the substrate, circuit board, base, and cover of the preferred embodiment, and including a ribbon cable.
Figure 4:
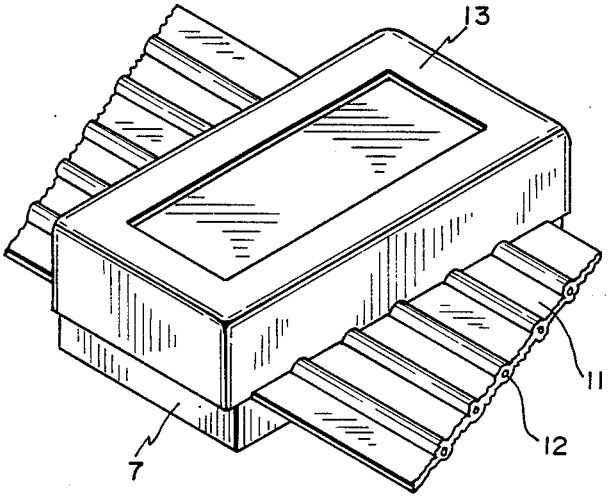
FIG. 4 is a perspective view of the preferred assembly after it has been attached to the cable.
Figure 5:
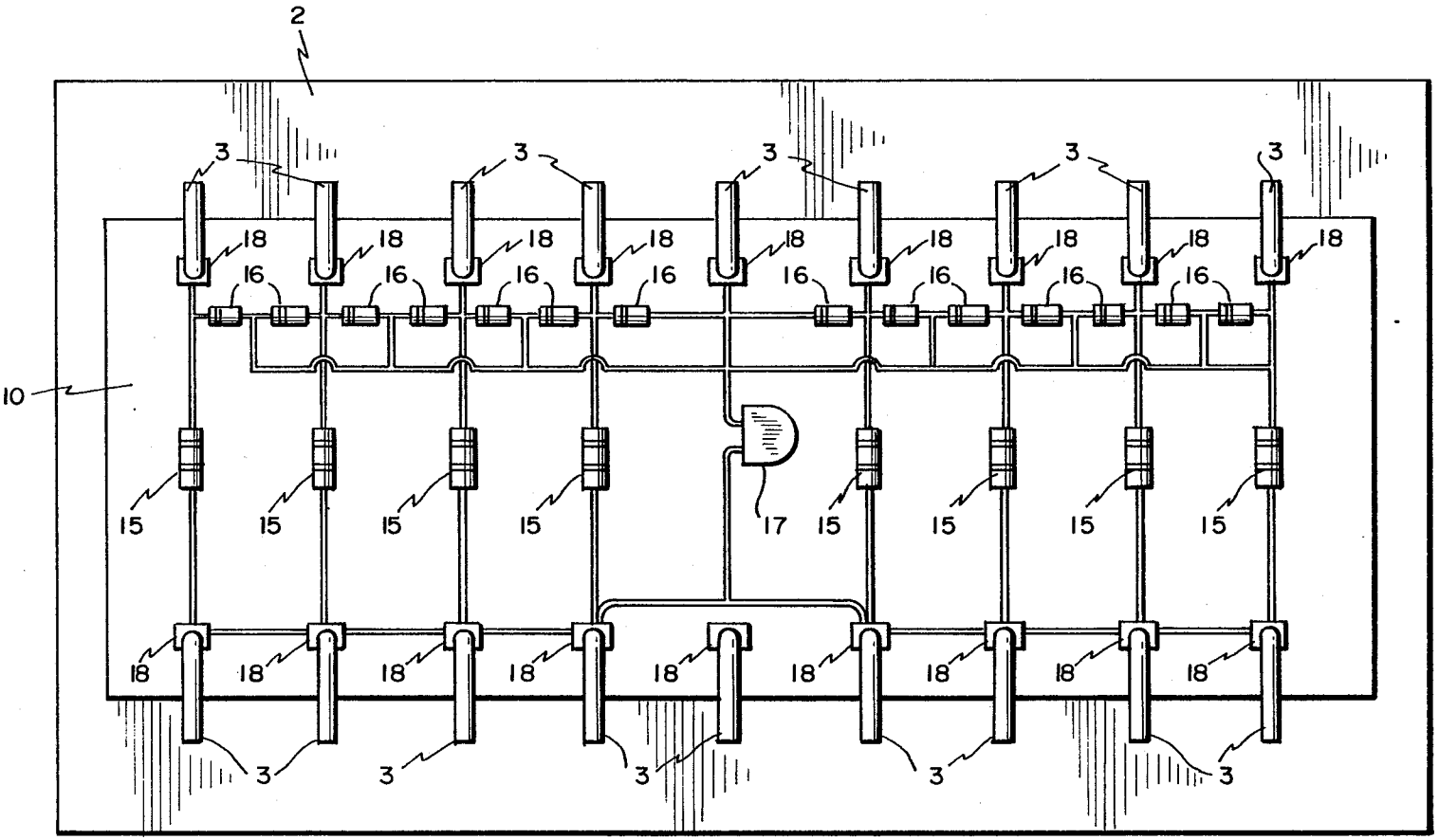
FIG. 5 is a top view of the substrate and circuit board of the preferred embodiment, including an exemplary terminator circuit.

FIGS. 1 through 4 show all of the components of a preferred embodiment of the invention, except for the cable termination circuit itself, which is shown in FIG. 5. The cable termination circuit is illustrated as a terminator, but other similar cable-ending circuits may be substituted including, but not limited to, filtering and noise suppression circuits.

A substrate 2 includes two rows of pins 3 and insulation displacement contacts 5. As shown in FIG. 3, contacts 5 are actually extensions of pins 3 so that electrical current can flow from pins 3 to contacts 5. Such insulation displacement contacts and corresponding pins are known in the art and their structure forms no part of this invention. It will be appreciated by those skilled in the art that numerous variations of the pins and contacts are possible, including the use of multiple-row pin arrangements.

Circuit board 10 is located between the rows of pins 3 on the substrate 2 and fixed with respect to the substrate by soldering of the pins to conductive landings 18 provided on the circuit board. As shown in FIG. 5, conductive landings 18 are provided in positions corresponding to pins 3. The landings are part of a printed terminator circuit which includes standard terminator components such as resistors 15 and 16, and capacitor 17.

The leads of the various components may be attached to the printed board in conventional fashion, either leaded or surface mounted, or the components themselves may be printed onto the board. Each of the pins is bent and soldered to a corresponding landing, thereby electrically connecting the circuit on the board with the pins 3 and contacts 5.

Figure 1:
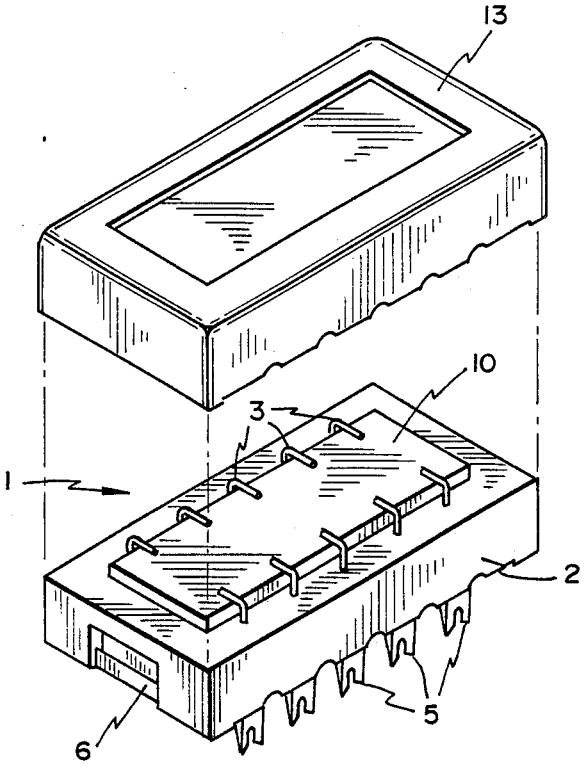
FIG. 1 is a perspective view of the substrate, circuit board, and optional cover of the terminator assembly according to a perferred embodiment of the invention.
Figure 2:
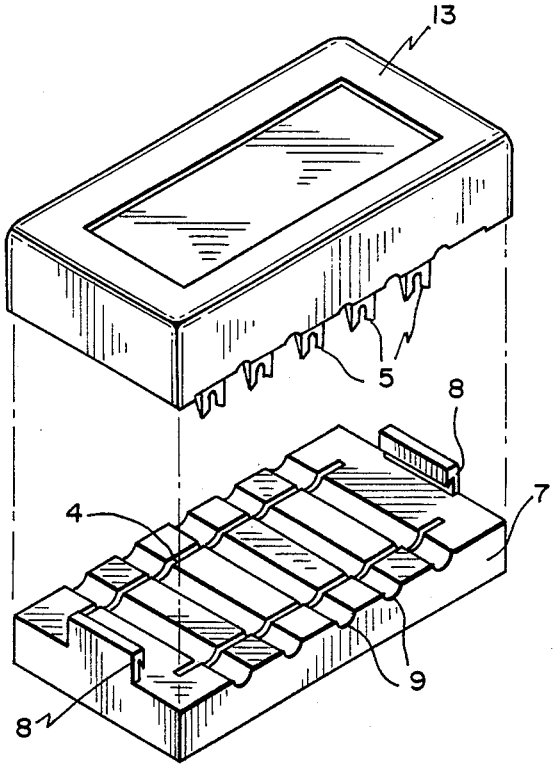
FIG. 2 is a perspective view of the preferred terminator assembly, with the cover mated to the substrate and including a separate base.

As shown in FIG. 2, recesses 4 may also be provided in the base to accommodate contacts 5, and recesses 9 provided to accommodate thicker areas of the cable. The specific shape and arrangement of recesses 4 and 9 will depend on the shape of the cable, and the design of the recesses being well within the skill of the ordinary artisan.

Referring to FIG. 3, the substrate 2 is provided with recesses 6 for aligning the substrate with base 7, and for clamping the base onto the substrate. Base 7 advantageously includes extensions 8 adapted to mate with recesses 6 such that extensions 8 and recesses 6 can be snapped together when the cable is placed between them, thereby securing the base and substrate together with the cable sandwiched therebetween. Other arrangements for attaching substrate and base are, of course, also possible, and are intended to be within the scope of the invention.

Cover 13 fits over the entire substrate. As shown in FIG. 3, shelf 14 is provided internally of the cover for aligning the cover with the substrate. However, other means for attaching the cover to the substrate may be used, numerous variations of which will occur to those skilled in the art. The cover itself may be made of molded plastic and include a label in addition to protecting the terminator circuit. It may be glued to the substrate along shelf 14, or attached by any other convenient means.

FIG. 4 shows the cover 13 secured to the substrate (not shown) which is in turn clamped to base 7 with a cable 11 sandwiched therebetween such that conductors 12 of the cable are electrically connected to the circuit board on the substrate (also not shown).

It will be recognized by those skilled in the art that the base and substrate as described above, when two rows of pins are used, are essentially equivalent to a DIP connector. Furthermore, by combining a DIP with a termination circuit in the manner described above, bending the two rows of pins over the edge of a board placed between the pins, the cost of the assembly can be minimized.

It is contemplated that the priciples of the invention will be applicable to a wide variety of DIP connectors, and therefore will also be useful in a wide variety of flat or ribbon cable applications. By using an already available DIP connectors, only the cover and circuit board will have to be specially manufactured.

2. Method.

Figure 6A:
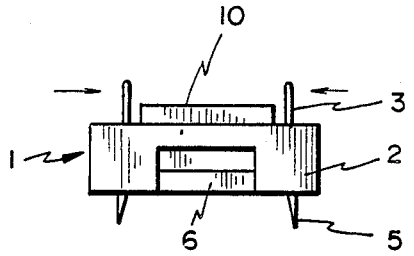
FIGS. 6(*a*)–(*d*) illustrate the preferred method of connecting a termination circuit to a ribbon cable.
Figure 6B:
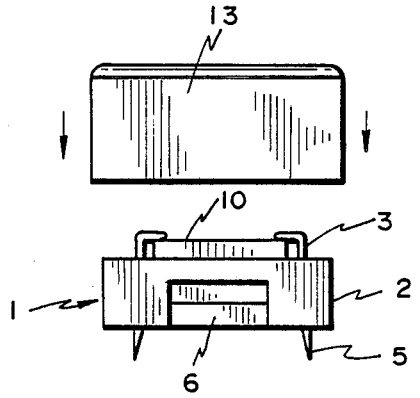
Figure 6C:
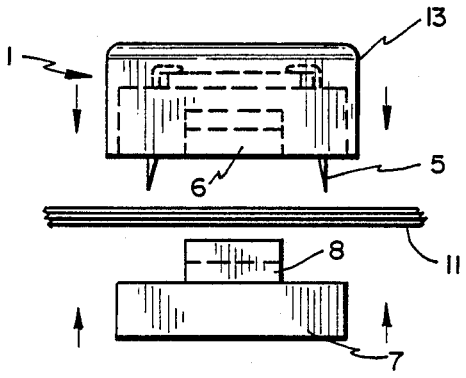
Figure 6D:
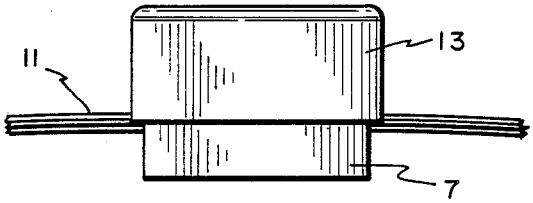

An especially advantageous method of connecting the termination circuit to the cable 11 will now be described in connection with FIGS. 6*a* to 6*d*. As shown in FIG. 6*a*, circuit board 10 is placed between the rows of pins and the pins are bent over the circuit board to contact the circuit at landings 18, at which time the pins may be soldered to the landings. A cover is then placed over a substrate to completely enclose the circuit board, as shown in FIG. 6*b*. It is anticipated that in some cases a cover might not be desired, in which case the step can be omitted.

The above described steps may be performed at a factory, while the following two steps may be performed in situ by the user. The enclosed terminator and the base are snapped together, sandwiching the cable and causing the contacts to penetrate the cable insulation to provide an electrical connection between conductors 12 and the circuit board, thus completing the assembly as shown in FIGS. 6(*c*) and 6(*d*).

Finally, in order to remove the termination circuit and move it to a different cable, the only steps necessary are unsnapping the base from the terminator, and clamping it onto another cable. This can easily be done by an ordinary user.

The foregoing description of the invention has been presented for purposes of illustration and description. It is not intended to be exhaustive or to limit the invention to the precise form disclosed, and other modifications and variations may be possible in light of the above teachings. It is therefore intended that the appended claims be construed to include other alternative embodiments of the invention except insofar as limited by the prior art.

What is claimed is:

1. An assembly for electrically connecting a cable termination circuit to a flat cable of the type including a plurality of conductors and surrounding insulation, comprising:

a substrate having a first surface and a second surface opposite the first surface;

at least two rows of electrically conductive pins projecting from said first surface and arranged to form a space between the rows;

insulation displacement contact means projecting from said second surface of said substrate for penetrating said insulation and making electrical contact between the conductors of said cable and said pins;

first securing means integral with said base and second securing means integral with said substrate and engageable with said first securing means for securing said substrate to said base, said contact means penetrating said insulation and making electrical contact with said conductors when said first securing means engages said second securing means and said cable is sandwiched between said substrate and said base; and a circuit board carrying said termination circuit and located on said first surface in said space between the rows of pins, said circuit board including means for electrically connecting said circuit with said pins when said pins are bent to contact said connecting means, thereby electrically connecting said termination circuit with said cable conductors.

2. An assembly as claimed in claim 1 further including a base adapted to mate with said substrate and clamp said cable therebetween, said contact means making electrical contact with said conductors when said substrate is clamped to said base.

3. An assembly as claimed in claim 1, wherein said cable termination circuit is a terminator.

4. An assembly as claimed in claim 1, wherein said base and said substrate each includes integral means for aligning and clamping said substrate to said base.

5. An assembly as claimed in claim 1, wherein said substrate and said base form a Dual In-line Pin connector.

6. An assembly as claimed in claim 1, wherein said first securing means comprises flexible projections integral with said base and said second securing means comprises recesses arranged to mate with said flexible projections, the projections flexing outwardly against their resilience as said base is pressed against said substrate, said projections returning to their unflexed position when said contacts have penetrated said insulation and made electrical contact with said conductors to thereby secure said substrate to said base.

7. An assembly as claimed in claim 1 further comprising cover means for enclosing said circuit board.

8. An assembly as claimed in claim 7, wherein said cover means is a molded plastic cover.

9. An assembly as claimed in claim 8, wherein said cover includes a shelf upon which an adhesive is applied to adhere said cover to said substrate.

10. A method of electrically connecting a cable termination circuit to a flat cable, comprising the steps of:

providing a substrate having a first surface and a second surface opposite the first surface, rows of electrically conductive pins projecting from said first surface, contact means projecting from said second surface of said substrate for making electrical contact between the conductors of said cable and said pins, and a base, said base including first securing means and said substrate including second securing means engageable with said first securing means for securing said substrate to said base, said contact means penetrating said insulation and making electrical contact with said conductors when said first securing means engages said second securing means and said cable is sandwiched between said base and said substrate;

placing a circuit board on said first surface of said substrate in a space between said rows of pins;

bending said pins to make electrical contact between said circuit and said pins;

placing said cable between said second surface and said base; and electrically connecting said cable to said contact means by pressing said base against said substrate to engage said first securing means with said second securing means when said cable is sandwiched between said base and said substrate.

11. A method as claimed in claim 10, further comprising the step of enclosing said circuit board in a cover attached to said substrate after the step of bending said pins and prior to the steps of placing a cable between said second surface and said base.

12. A method as claimed in claim 10, further comprising the step of soldering said pins to said circuit board after the step of bending said pins to make electrical contact.

13. A method as claimed in claim 10, wherein said step of pressing said base against said substrate is accomplished by snapping said base onto said substrate.

14. A method of electrically connecting a cable termination circuit to a flat cable, comprising the steps of:

providing a substrate having a first surface and a second surface opposite the first surface, rows of electrically conductive pins projecting from said first surface, contact means projecting from said second surface of said substrate for making electrical contact between the conductors of said cable and said pins, and a base;

placing a circuit board on said first surface of said substrate in a space between said rows of pins;

making electrical contact between said circuit and said pins;

permanently enclosing said circuit board in a cover attached to said substrate;

placing a cable between said second surface of said substrate and said base; and electrically connecting said cable to said contact means by pressing said base against said substrate with said cable therebetween.

15. A method of electrically connecting a cable termination circuit to a flat cable, comprising the steps of:

providing a substrate having a first surface and a second surface opposite the first surface, rows of electrically conducting pins projecting from said first surface, contact means projecting from said second surface of said substrate for making electrical contact between the conductors of said cable and said pins, and a base, said base being adapted to mate with said substrate for sandwiching a cable between the substrate and the base;

placing a circuit board on said first surface of said substrate in a space between said rows of pins;

making electrical contact between said circuit and said pins;

and permanently enclosing said circuit board in a cover by adhering the cover to said substrate.

16. An assembly for electrically connecting a cable termination circuit to a flat cable of the type including a plurality of conductors and surrounding insulation, comprising:

a substrate having a first surface and a second surface opposite the first surface, said first surface of the substrate carrying at least two rows of electrically conductive terminals arranged to form a space between the rows;

insulation displacement contact means projecting from said second surface of said substrate for penetrating said insulation and making electrical contact between the conductors of said cable and said terminals;

first securing means integral with said base and second securing means integral with said substrate and engageable with said first securing means for securing said substrate to said base, said contact means penetrating said insulation and making electrical contact with said conductors when said first securing means engages said second securing means and said cable is sandwiched between said base and said substrate; and a circuit board carrying said termination circuit and located on said first surface in said space between the rows of terminals, said circuit board including means for electrically connecting said circuit with said terminals, thereby electrically connecting said circuit elements with said cable conductors.

17. A method of electrically connecting a cable termination circuit to a flat cable, comprising the steps of:

providing a substrate having a first surface and a second surface opposite the first surface, rows of electrically conductive terminals arranged in rows on said first surface with a space between said rows, contact means projecting from said second surface of said substrate for making electrical contact between the conductors of said cable and said terminals, and a base, said base including first securing means and said substrate including second securing means engageable with said first securing means for securing said substrate to said base, said contact means penetrating said insulation and making electrical contact with said conductors when said first securing means engages said second securing means with said cable sandwiched therebetween;

placing a circuit board on said first surface of said substrate and said space between said rows of terminals;

electrically connecting said circuit and said terminals;

placing said cable between said second surface and said base; and electrically connecting said cable to said contact means by pressing said base against said substrate to engage said first securing means with said second securing means when said cable is sandwiched between said base and said substrate.

18. An assembly for electrically connecting a cable termination circuit to a flat cable of the type including a plurality of conductors and surrounding insulation, comprising:

a substrate having a first surface and a second surface opposite the first surface;

at least two rows of electrically conductive pins projecting from said first surface and arranged to form a space between the rows;

insulation displacement contact means projecting from said second surface of said substrate for penetrating said insulation and making electrical contact between the conductors of said cable and said pins;

a circuit board carrying said termination circuit and located on said first surface in said space between the rows of pins, said circuit board including means for electrically connecting said circuit with said pins when said pins are bent to contact said connecting means, thereby electrically connecting said circuit elements with said cable conductors; and cover means including a molded plastic cover for enclosing said circuit board, said cover including a shelf upon which an adhesive is applied to adhere said cover to said substrate.

19. A method of electrically connecting a cable termination circuit to a flat cable, comprising the steps of:

providing a substrate having a first surface and a second surface opposite the first surface, rows of electrically conductive pins projecting from said first surface, contact means projecting from said second surface of said substrate for making electrical contact between the conductors of said cable and said pins, and a base;

placing a circuit board on said first surface of said substrate in a space between said rows of pins;

bending said pins to make electrical contact between said circuit and said pins;

placing a cable between said second surface and said base;

electrically connecting said cable to said contact means by pressing said base against said substrate with said cable therebetween; and enclosing said circuit board in a cover attached to said substrate after the step of bending said pins and prior to the steps of placing a cable between said second surface and said base.

* * * * *